US009423195B2

(12) United States Patent
Daley, Jr. et al.

(10) Patent No.: US 9,423,195 B2
(45) Date of Patent: Aug. 23, 2016

(54) CHARGING HANDLE

(71) Applicant: Sig Sauer, Inc., Newington, NH (US)

(72) Inventors: William C. Daley, Jr., Kingston, NH (US); Christopher Sirois, Newfields, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 14/834,038

(22) Filed: Aug. 24, 2015

(65) Prior Publication Data

US 2016/0061542 A1 Mar. 3, 2016

Related U.S. Application Data

(60) Provisional application No. 62/043,628, filed on Aug. 29, 2014.

(51) Int. Cl.
*F41A 3/72* (2006.01)
*F41A 35/06* (2006.01)

(52) U.S. Cl.
CPC .. *F41A 3/72* (2013.01); *F41A 35/06* (2013.01)

(58) Field of Classification Search
CPC ..... F31A 3/72; F41A 35/06
USPC ..... 89/1.4, 191.01, 191.02, 1.42; 42/2, 16
See application file for complete search history.

(56) References Cited

U.S. PATENT DOCUMENTS

| | | | | |
|---|---|---|---|---|
| 7,240,600 | B1 | 7/2007 | Bordson | |
| 7,707,921 | B1 * | 5/2010 | Hoel | F41A 35/06 42/16 |
| 7,900,546 | B2 | 3/2011 | Bordson | |
| 2004/0055198 | A1 * | 3/2004 | Gussalli Beretta | F41A 35/06 42/46 |
| 2008/0156309 | A1 * | 7/2008 | Kung | F41A 3/72 124/31 |
| 2010/0000396 | A1 * | 1/2010 | Brown | F41A 3/72 89/1.4 |
| 2010/0300278 | A1 * | 12/2010 | Zedrosser | F41A 3/26 89/180 |
| 2015/0192376 | A1 * | 7/2015 | Dickinson | F41A 3/72 89/1.4 |
| 2016/0047614 | A1 * | 2/2016 | Larson, Jr. | F41G 11/003 89/191.01 |

* cited by examiner

*Primary Examiner* — Samir Abdosh
*Assistant Examiner* — John D Cooper
(74) *Attorney, Agent, or Firm* — Finch & Maloney PLLC

(57) ABSTRACT

A charging handle that may be assembled to a firearm in either of multiple configurations to enable actuation of the charging handle from either a left hand side or a right hand side of the firearm.

15 Claims, 4 Drawing Sheets

CHARGING HANDLE

RELATED APPLICATION

This application claims the benefit under 35 U.S.C. §119 (e) of U.S. Provisional Patent Application Ser. No. 62/043,628, titled "CHARGING HANDLE" filed Aug. 29, 2014, which is incorporated herein by reference in its entirety.

FIELD

This disclosure relates to charging handles for firearms and particularly to charging handles for automatic or semi-automatic rifles such as AR-10, AR-15, M16, and M4 type firearms.

BACKGROUND

Automatic or semi-automatic firearms typically include a bolt that cycles backward and forward between shots. The bolt acts to cycle a spent (or fresh) cartridge casing from the firing chamber of the firearm and to load a fresh cartridge for subsequent firing. Depending on the particular firearm, automated movement of the bolt may be propelled by recoil of the firearm and/or expanding gas associated with discharge of a previous round. Rearward movement of the bolt causes an extractor to engage and draw the spent (or fresh) casing from the firing chamber. The bolt returns forward, often under action of a spring, after the casing is ejected from the firearm. Forward movement of the bolt engages a fresh cartridge from a magazine and pushes the cartridge into the firing chamber for subsequent firing.

Automated cycling of a bolt may not occur under all circumstances. An operator may cycle a bolt manually to initially load a fresh cartridge into the firing chamber from a magazine that has just been loaded into the firearm. Similarly, a bolt may not fully cycle after the final cartridge from a magazine is spent. There may be additional instances when an operator wishes to cycle the action of a firearm (i.e., move the bolt through a cycle), such as for inspection or to clear a cartridge.

A charging handle is incorporated into some firearms, including AR-10, AR-15, M16, and M4 type firearms, that may be pulled by an operator to move a bolt and any associated components rearward through a portion of the action of the firearm. Conventional charging handles includes a finger that extends downward within the firearm to engage the bolt carrier when the charging handle is actuated by an operator. This finger, among other features, prevents the charging handle from being assembled to the firearm in more than one configuration.

SUMMARY

Described herein is a charging handle for a firearm. A hand pull is at a proximal portion of the charging handle. An elongate body extends distally away from the hand pull toward a distal portion of the charging handle. A latch selectively latches the charging handle in a forward position on the firearm. A latch release actuates the latch to release the charging handle from the forward position on the firearm enabling the charging handle to be pulled rearward in relation to the firearm from the forward position. A first abutment is positioned on the distal portion of the elongate body and faces proximally toward the hand pull. The first abutment is positioned to be accessible within the firearm from below when the charging handle is assembled to the firearm with the latch release on a left hand side of the firearm. A second abutment is positioned on the distal portion of the elongate body and faces proximally toward the hand pull. The second abutment is positioned to be accessible within the firearm from below when the charging handle is assembled to the firearm with the latch release positioned on a right hand side of the firearm. In this respect, the charging handle design may enable ambidextrous assembly to the firearm. Firearm operator may thus choose which side of the firearm to place the latch release of the charging handle, enabling easier operation of the firearm for both left-handed and right-handed operators.

Also described herein is a method of reconfiguring a charging handle of a firearm. The method includes providing a firearm having a charging handle oriented with a latch release extending from a first lateral side of the firearm. The charging handle is disassembled from the firearm and is reassembled to the firearm with the latch release extending from a second lateral side of the firearm, opposite to the first lateral side of the firearm. According to some examples, disassembling and reassembling the charging handle from and to the firearm occurs as part of an act of field stripping the firearm.

The subject matter of this application may involve, in some cases, interrelated products, alternative solutions to a particular problem, and/or a plurality of different uses of a single system or article.

The present disclosure is not intended to be limited to a system or method that must satisfy one or more of any stated objects or features. Modifications and substitutions by one of ordinary skill in the art are considered to be within the scope of the present invention.

BRIEF DESCRIPTION OF THE DRAWINGS

In the drawings, different embodiments of the invention are illustrated in which.

DETAILED DESCRIPTION OF THE DRAWINGS

Described herein is a charging handle that may be assembled to a firearm in either of multiple configurations to enable actuation from either a left-hand side or a right-hand side of the firearm. That is, the charging handle design enables ambidextrous assembly to the firearm. In this respect, a latch release of the charging handle may be positioned on a side of the firearm that faces away from the firearm operator in normal use. Positioning in this manner prevents the latch release from interfering with clothing and/or other gear of the operator. An ability to move the latch release to a side of the firearm that faces away from the operator may also enable use of a larger latch release that may be actuated by an operator with greater ease.

According to one embodiment, an ambidextrous charging handle may be assembled to a firearm in either of a first configuration for left-handed operation or a second configuration for right-handed operation. In the first configuration, a first abutment of the charging handle may be accessed from below the firearm by a corresponding feature of the bolt group (i.e., the bolt and components of the firearm that move with the bolt through at least a portion of the action of the firearm). A second abutment of the charging handle may be accessed from below by the corresponding feature of the bolt group when the firearm is assembled with the charging handle in a second configuration that is flipped about a horizontal plane, as taken with respect to the firearm in a normal operational orientation, to the first configuration.

Figure 1:
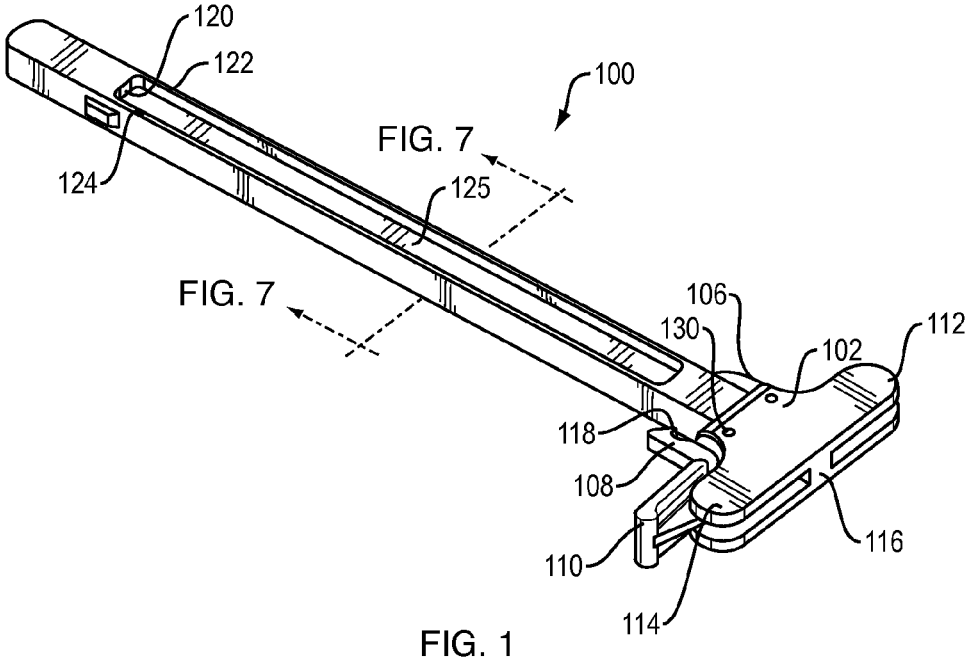
FIG. 1 shows a perspective view of a charging handle, according to one embodiment.
Figure 2:
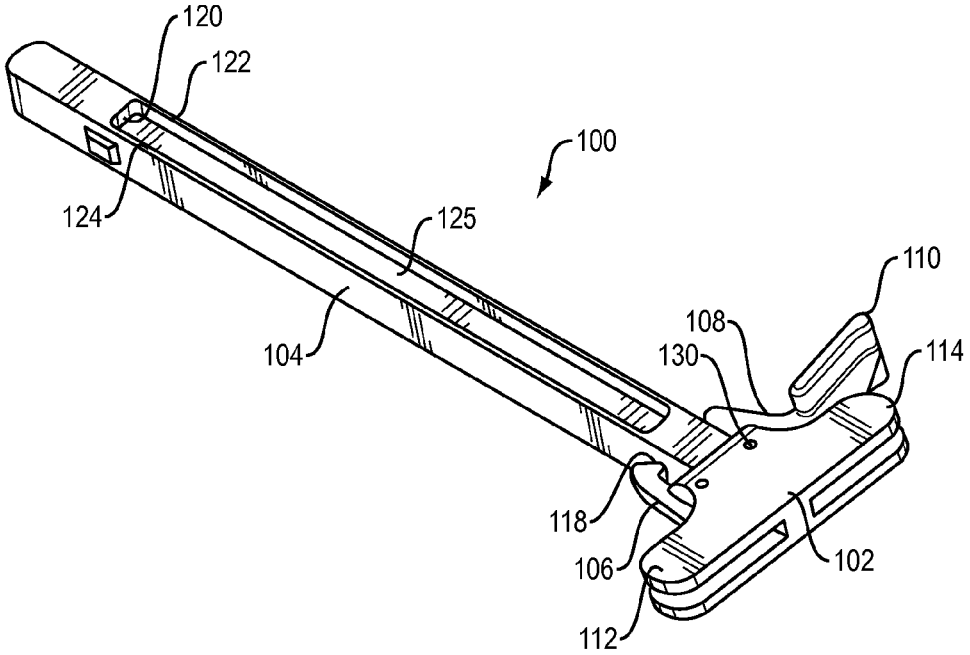
FIG. 2 shows a perspective view of the charging handle of FIG. 1, flipped about a horizontal plane with respect to the view of FIG. 1.
Figure 3:
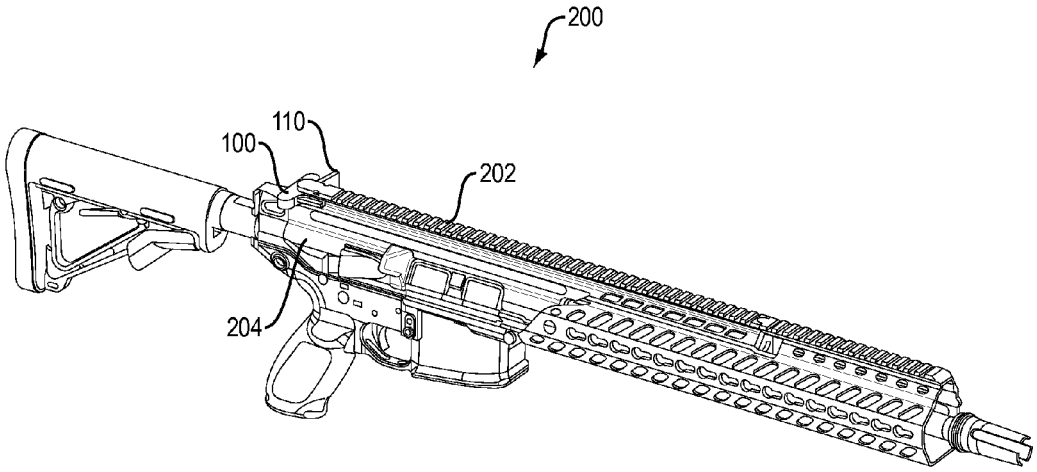
FIG. 3 shows the charging handle of FIG. 1 assembled to a firearm with a latch release of the charging handle positioned on a left-hand side of the firearm.
Figure 4:
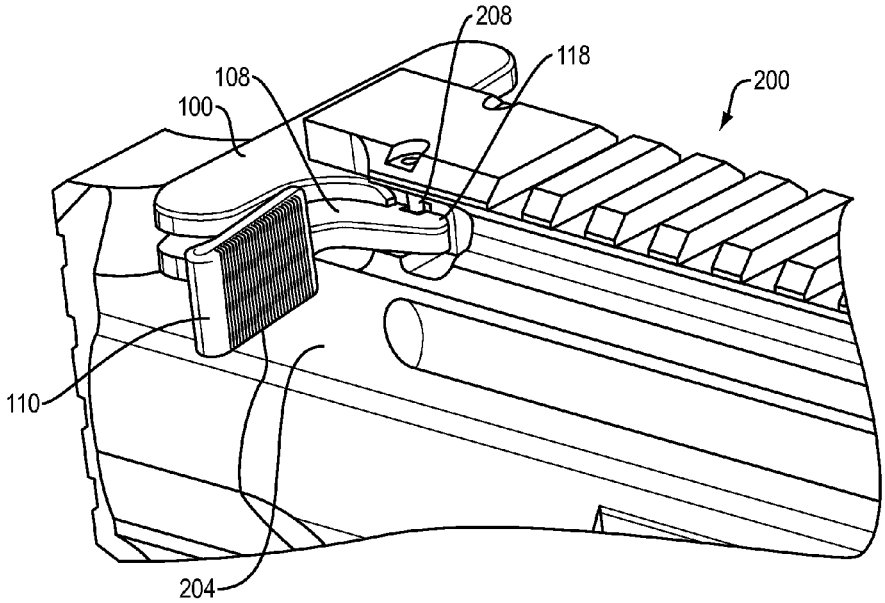
FIG. 4 shows a close up view of the charging handle of FIG. 1 assembled to a firearm with a latch release of the charging handle positioned on a right-hand side of the firearm.

Turn now to the figures, and initially FIGS. 1 and 2 that show perspective views of a charging handle 100 according to one embodiment. The charging handle includes a hand pull 102, an elongate body 104, a pair of latches 106, 108, and a latch release 110. FIG. 3 shows the charging handle of FIG. 1 assembled in a firearm 200 in a first configuration, with the charging handle in a forward positioned and a latch release 110 of the charging handle positioned on a left-hand side 202 of the firearm. FIG. 4 is a closer view of the firearm, showing the charging handle 100 of FIG. 2 configured with the latch release 110 positioned on a right-hand side 204 of the firearm.

The hand pull 102 of the charging handle 100 shown in FIGS. 1 and 2 is constructed to facilitate ease of actuation by the firearm operator. The illustrated hand pull 102 includes first and second lateral portions 112, 114 that each extends in opposite directions. The lateral portions 112, 114 provide structures on opposite sides of the elongate body 104 that may be pulled by an operator in a manner that minimizes side loading through interaction between the elongate body 104 of the charging handle and surfaces within the firearm. The hand pull 102 also includes a rear surface 116 that is shaped to be readily pushed forward by an operator to move the charging handle forward. In the illustrated embodiment, the hand pull includes a generally wide and flat rear surface to accomplish this, although other configurations are also contemplated.

The charging handle includes one or more latches that may selectively latch the charging handle in a forward position within the firearm. In the embodiment shown in FIGS. 1 and 2, latches are positioned on each lateral side of the charging handle. Each latch is pivotally mounted to the hand pull 102 and extends forward along a proximal portion of the elongate body 104. A distal portion of each latch includes a latching feature 118, such as a hook, that may engage a corresponding feature 208 of the firearm, such as shown in FIG. 4, to selectively latch the charging handle in place. Actuation of the latches by an operator moves the engagement feature away from the firearm in a manner that frees the charging handle for rearward movement.

The embodiment illustrated in FIGS. 1 and 2 includes a pair of opposed latches 106, 108 that may be actuated together, as described herein. Embodiments that include a pair of latches may provide additional prevention against unwanted release of the charging handle. Latches arranged on opposed sides of the charging handle, among other configurations, may also prevent uneven wear patterns and/or unwanted side loading between the charging handle and firearm through use. It is to be appreciated that although embodiments are illustrated with a pair of latches, that other configurations are possible and are contemplated, including embodiments that have a single latch.

Figure 5:
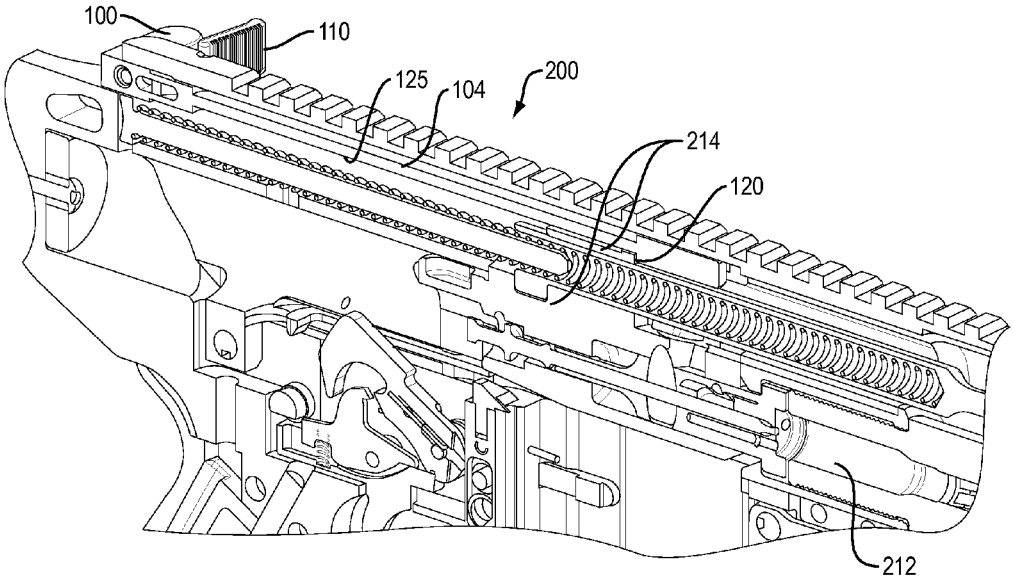
FIG. 5 is a cross-sectional view of a firearm, showing the charging handle of FIG. 1 in a forward position.
Figure 6:
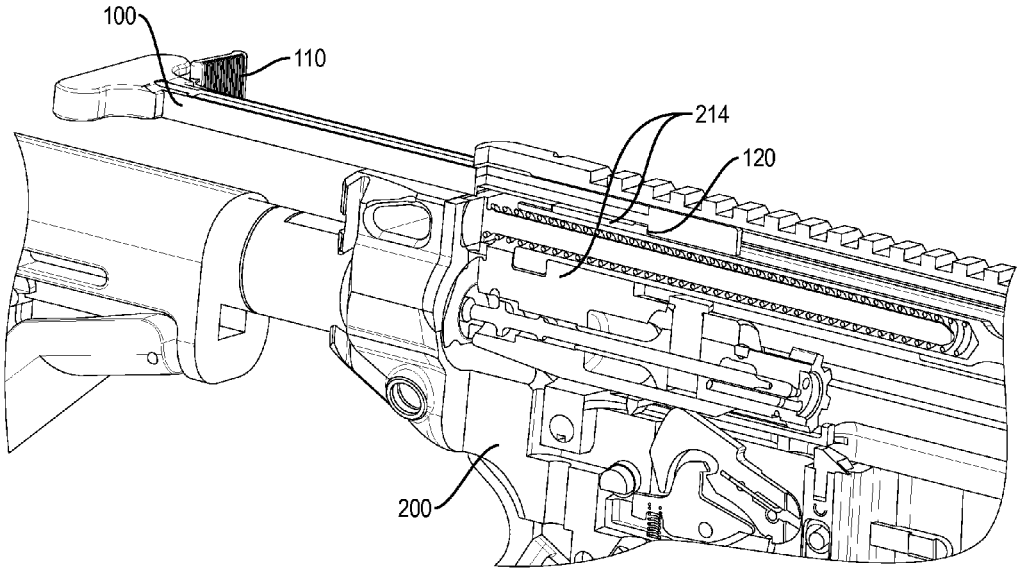
FIG. 6 is a cross-sectional view of a firearm, showing the charging handle of FIG. 1 in a rearward position.

One of the pair of latches 106, 108 on the charging handle illustrated in FIGS. 1-4 includes a paddle shaped latch release 110. The latch release, when actuated by an operator, releases the latches 106 and/or 108 from engagement with the firearm so that the charging handle may be pulled rearward, moving the bolt group 214 or portions thereof away from the firing chamber 212, as shown through the views of FIGS. 5 and 6. The illustrated embodiment includes only a single latch release, positioned on one lateral side of the charging handle. It is to be appreciated, however, that other embodiments may include a latch release on both sides and/or of different shapes.

Latch releases may be engaged by an operator in different manners to release the charging handle for movement. In the illustrated embodiment, the latch release 110 is pulled rearward by the operator to release latches 106, 108 from the firearm 200. In this manner, the operator may actuate the latch release as a part of the same motion used to pull the charging handle rearward. Other configurations are also contemplated, including latch releases that are moved in different directions and latch releases of different shapes and sizes than those illustrated herein. According to one embodiment, the latch release has a substantially smaller area that is depressed or otherwise actuated to release the latch.

A single latch release may actuate multiple latches, according to some embodiments. In the illustrated embodiment, pulling the latch release 110 causes each of the latches 106, 108 to disengage from the firearm 200 by way of interaction between each of the latches. A first of the illustrated latches 108 is integral (i.e., machined or otherwise formed from a common element) with the latch release 110 and thus moves when the latch release 110 is pivoted about a pin 130 that holds the latch release to the hand pull 102. A second latch 106 may be in contact, either directly or indirectly, with the first latch 108 or the latch release 110, such that movement of the latch release 110 also moves the second latch 106 out of engagement with the corresponding feature 208 of the firearm. A spring or other biasing element may optionally be included to urge the latches toward the engagement with the firearm.

The elongate body 104 of the charging handle includes an abutment 120 that engages a corresponding feature of the bolt group 214 in the firearm 200 when the charging handle 100 is pulled rearward with the bolt group in a forward position. This enables the charging handle to make contact with and pull the bolt group 214 rearward, through at least a portion of the action of the firearm. As shown in FIGS. 1 and 2, the abutment is positioned at a distal portion of the elongate body and faces rearward, toward the hand pull 102 of the charging handle.

Figure 8:
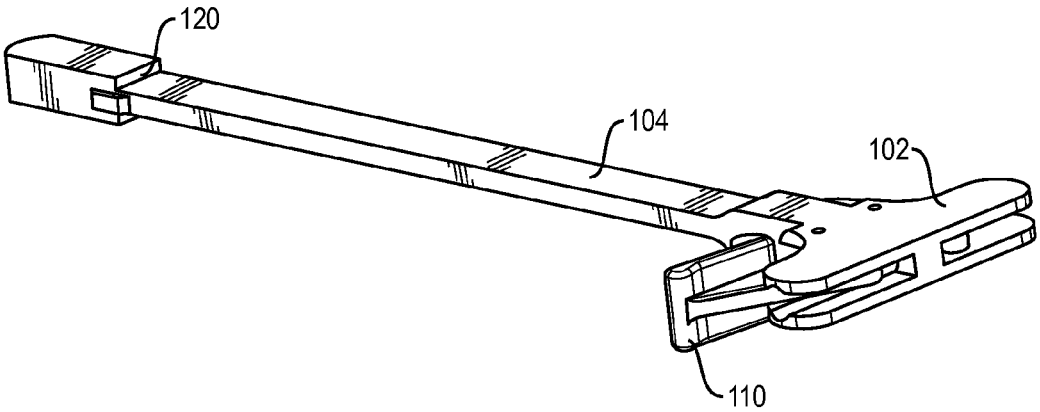
FIG. 8 shows a perspective view of a charging handle, according to another embodiment.

Supports 122, 124 are positioned alongside the abutment that extend rearward, toward the hand pull 102 of the charging handle. These abutment supports 122, 124 may strengthen the elongate body, preventing flexure when the charging handle is pulled rearward by the operator with the abutment 120 engaging the bolt group 214. The illustrated supports 122, 124 define a recess 125 within the length of the elongate body 104, along with the abutment 120 and other portions of the elongate body. This recess 125 may receive a portion of the bolt group 214, allowing the bolt group freedom of movement therein in the fore and aft directions as the bolt group moves through the action of the firearm. It is to be appreciated that alternate embodiments, such as the embodiment of FIG. 8, may lack abutment supports and/or other features altogether.

Figure 7:
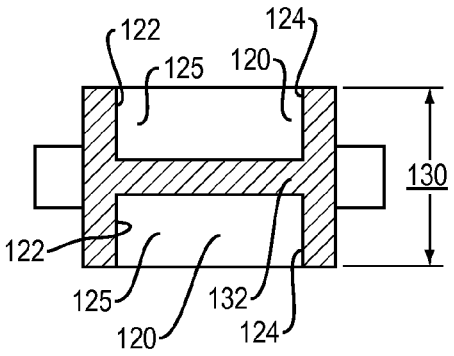
FIG. 7 is a cross-sectional view of the elongate body of the charging handle, taken through a plane and viewed in a direction as indicated in FIG. 1.

As may be seen in FIG. 7, portions of the elongate body may include an "I" shaped cross-section defined by the abutment supports and a connection 132 therebetween, according to one embodiment. The recesses 125 and the abutments 120 that engage the bolt group are also shown in FIG. 7. The general symmetry that exists about a horizontal plane of the charging handle is one that enables ambidextrous assembly to a firearm, according to some embodiments. It is to be appreciated that such symmetry may exist in alternate embodiments, such as an embodiment that lacks the central connection of the "I" that extends between abutment supports 122 and 124 of each side of the elongate body. That is, according to another embodiment, the recesses 125 associated with each abutment 120 may be in open communication with one another. According to some embodiments, the abutments of each side of the charging handle may be formed of the same surface.

Another feature that, additionally or alternately, enables ambidextrous assembly includes the height 130 of the elongate body, as shown in FIG. 7. According to some embodiments, the maximum height of the elongate body between horizontal planes that touch the uppermost and lowermost portions of the elongate body, when in an operational orientation, is no more than 0.5 inches. no more than 0.4 inches, no more than 0.3 inches, no more than 0.275 inches, or even no more than 2.5 inches, according to various embodiments. Inclusion of the abutment or abutments 120 within such a height may also enable ambidextrous assembly of the charging handle. That is, having an abutment or abutments recessed within the elongate body may help create an ambidextrous design, according to some embodiments.

The abutment 120 and associated features (abutment supports, recess, and the like) are present on opposed surfaces of the elongate body. This may be seen in each of FIGS. 1 and 2, which show the charging handle in each of two views, flipped about a horizontal plane that extends through the latch release 110 and the elongate body 104. Having abutments 120 on each side of the charging handle 100 enables assembly to the firearm 200 in either of two configurations, also flipped about the horizontal plane. In one of the configurations, the latch release 110 lies on a left-hand side 202 of the firearm while in the other the latch release lies on the right-hand side 204 of the firearm 200. As illustrated, the elongate body 104 and other portions of the charging handle 100 are symmetrical about a horizontal plane. It is to be appreciated, however, that other embodiments may be assembled to a firearm in configurations that are flipped about a horizontal plane without such symmetry.

According to some embodiments, the charging handle may be assembled to a firearm without tools. In this respect, reconfiguration of the charging handle may be accomplished during a field stripping of the firearm (i.e., during a tool free disassembly/reassembly). To change the configuration of the charging handle between a left hand and a right hand configuration, the orientation of the charging handle is flipped about a horizontal plane in relation to the firearm such that the latch release extends from a different lateral side of the firearm.

While several embodiments have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of this disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of this disclosure is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, along with other embodiments that may not be specifically described and claimed.

All definitions, as defined herein either explicitly or implicitly through use should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A charging handle for a firearm, the charging handle comprising:

a hand pull at a proximal portion of said charging handle;

an elongate body that extends distally away from said hand pull toward a distal portion of said charging handle;

a latch configured to selectively latch said charging handle in a forward position on the firearm;

a latch release configured to actuate said latch to release said charging handle from the forward position on the firearm enabling said charging handle to be pulled rearward in relation to the firearm from the forward position;

a first abutment positioned on a distal portion of said elongate body and that faces proximally toward said hand pull when said charging handle is assembled to the firearm with said latch release on a left-hand side of the firearm, defining a first position of the charging handle; and a second abutment positioned on said distal portion of said elongate body and that faces proximally toward said hand pull when said charging handle is assembled to the firearm with said latch release positioned on a right-hand side of the firearm, defining a second position of the charging handle, wherein the first position of the charging handle and the second position of the charging handle are separated by a 180° rotation of the charging handle and the first abutment and the second abutment are each configured to interact with a feature of a bolt group of the firearm.

2. The charging handle of claim 1, wherein said elongate body exhibits symmetry about a plane that lies through said elongate body, said hand pull, and said latch release.

3. The charging handle of claim 1, wherein said latch includes a pair of latches that are operatively connected to one another.

4. The charging handle of claim 3, wherein said latch release is integrally formed with one of said pair of latches.

5. The charging handle of claim 1, wherein said latch release includes a paddle shaped surface that is pulled proximally, toward said hand pull, to actuate said latch release.

6. The charging handle of claim 5, wherein said hand pull includes a lateral hand pull portion configured to be pulled by a hand of an operator and wherein said paddle shaped surface of said latch release extends laterally beyond said lateral hand pull portion.

7. The charging handle of claim 1, further comprising one or more first abutment supports that extend proximally toward said hand pull from said first abutment.

8. The charging handle of claim 7, further comprising one or more second abutment supports that extend proximally toward said hand pull from said second abutment.

9. The charging handle of claim 8, wherein said one or more first abutment supports and said first abutment define at least a portion of a first recess in said elongate body.

10. The charging handle of claim 9, wherein said one or more second abutment supports and said second abutment define at least a portion of a second recess in said elongate body.

11. The charging handle of claim 1, in combination with said firearm.

12. The charging handle of claim 11, wherein said firearm is one of an AR-10, AR-15, M4, and M16 firearm.

13. A method of reconfiguring a charging handle of a firearm, the method comprising:

providing a firearm having a bolt group and a charging handle comprising an elongate body having a first abutment and a second abutment, the charging handle oriented in a first position with a latch release extending from a first lateral side of the firearm with the first abutment configured to interact with a feature of the bolt grain;

disassembling the charging handle from the firearm;

reassembling the charging handle to the firearm in a second position with the latch release extending from a second lateral side of the firearm, the second lateral side of the firearm opposite to the first lateral side of the firearm with the second abutment configured to interact with a feature of the bolt group; and rotating the charging handle 180° between the first position and the second position.

14. The method of claim 13, wherein disassembling and reassembling the charging handle from and to the firearm occurs as part of an act of field stripping the firearm.

15. The method of claim 13, wherein reassembling the charging handle to the firearm includes flipping the charging handle without tools about a horizontal plane in relation to the firearm such that the latch release extends from the second lateral side of the firearm.

* * * * *